US009134644B2

(12) United States Patent
Yamaguchi et al.

(10) Patent No.: US 9,134,644 B2
(45) Date of Patent: Sep. 15, 2015

(54) CHARGING MEMBER CONTAMINATION DETERMINING DEVICE

(71) Applicant: FUJI XEROX CO., LTD., Tokyo (JP)

(72) Inventors: Yoshiro Yamaguchi, Kanagawa (JP); Toru Ishii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/299,553

(22) Filed: Jun. 9, 2014

(65) Prior Publication Data

US 2015/0110506 A1 Apr. 23, 2015

(30) Foreign Application Priority Data

Oct. 22, 2013 (JP) ..... 2013-218983

(51) Int. Cl.
*G03G 15/02* (2006.01)

(52) U.S. Cl.
CPC ..... *G03G 15/0266* (2013.01)

(58) Field of Classification Search
CPC . G03G 15/55; G03G 15/553; G03G 15/0291; G03G 15/5058
USPC ..... 399/31
See application file for complete search history.

(56) References Cited

U.S. PATENT DOCUMENTS

| | | | | |
|---|---|---|---|---|
| 5,583,616 | A * | 12/1996 | Yamamoto et al. | 399/51 |
| 2013/0195476 | A1* | 8/2013 | Yada et al. | 399/31 |
| 2013/0308970 | A1* | 11/2013 | Sato et al. | 399/50 |
| 2014/0147140 | A1* | 5/2014 | Shirakata et al. | 399/50 |

FOREIGN PATENT DOCUMENTS

| | | |
|---|---|---|
| JP | A-2005-352162 | 12/2005 |
| JP | A-2007-52302 | 3/2007 |
| JP | A-2010-197609 | 9/2010 |

* cited by examiner

*Primary Examiner* — Walter L Lindsay, Jr.
*Assistant Examiner* — Frederick Wenderoth
(74) *Attorney, Agent, or Firm* — Oliff PLC

(57) ABSTRACT

Provided is a charging member contamination determining device including plural units that includes a charging member, a member to be charged and a measuring section that measures a discharging current value between the charging member and the member to be charged, a calculating section that calculates a difference between current values measured by two units among the plural units, and a determining section that determines the presence or absence of contamination in the charging member based on the difference between the current values for each combination of two units calculated by the calculating section.

11 Claims, 9 Drawing Sheets

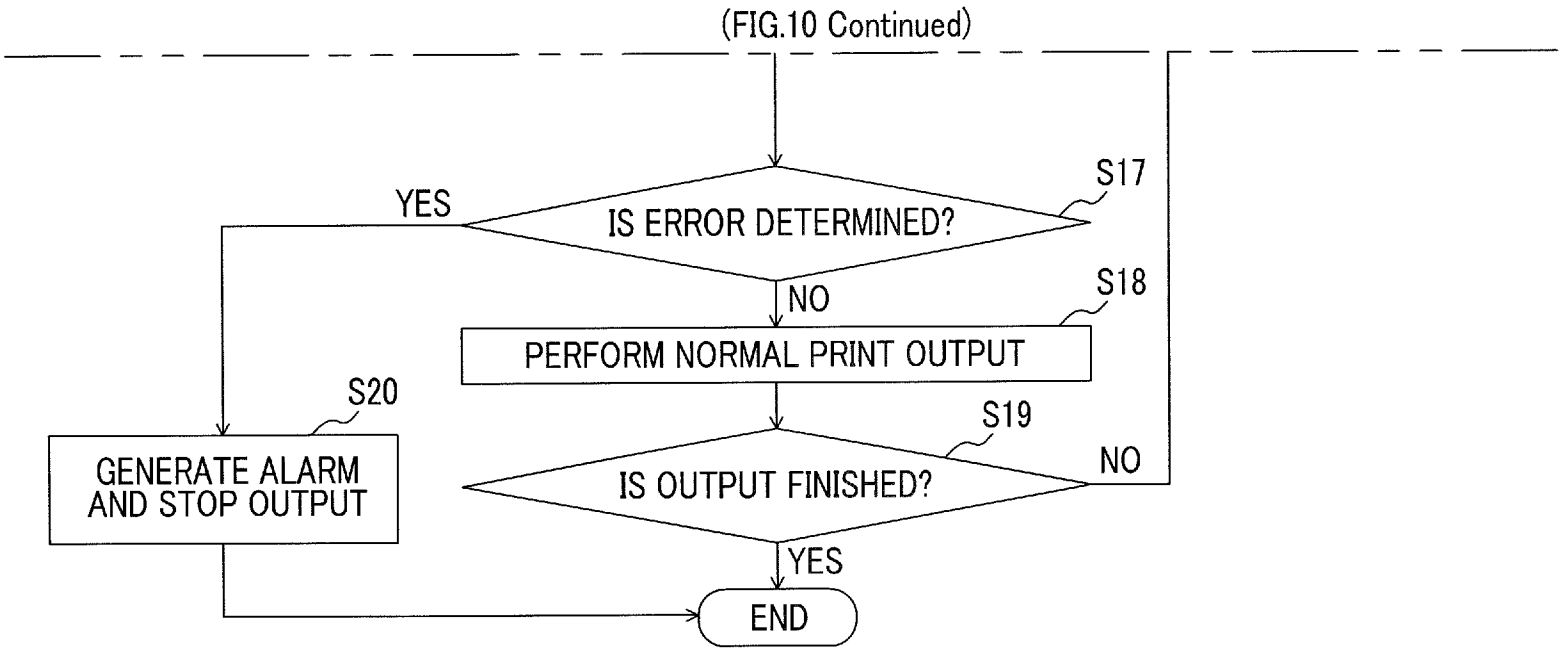
(FIG.10 Continued)
S17
IS ERROR DETERMINED?
YES
NO
S18
PERFORM NORMAL PRINT OUTPUT
S19
IS OUTPUT FINISHED?
NO
YES
END
S20
GENERATE ALARM AND STOP OUTPUT

CHARGING MEMBER CONTAMINATION DETERMINING DEVICE

CROSS-REFERENCE TO RELATED APPLICATIONS

This application is based on and claims priority under 35 USC 119 from Japanese Patent Application No. 2013-218983 filed Oct. 22, 2013.

BACKGROUND (i) Technical Field

The present invention relates to a charging member contamination determining device.

(ii) Related Art

As an image forming apparatus having a function of forming an image on a recording material such as a sheet, a copier, a printer, a facsimile and a multifunction device having these functions have been proposed.

In such an image forming apparatus, developer in which toner is mixed with carrier and charging accelerator is used. For example, in a developing unit provided in the image forming apparatus, the toner in the developer contained in a container is attached to a developing roller, and the toner is carried onto a photoconductor drum by rotation of the developing roller, so that an electrostatic latent image formed on the photoconductor drum is developed by the toner. The toner image on the photoconductor drum is transferred onto a recording material through an intermediate image transfer belt.

The photoconductor drum is a member to be charged having a structure that is charged by a charging member provided in contact with or close to the photoconductor drum. If the charging member is contaminated due to attachment of the toner or the like, the member to be charged is not charged with a uniform electric potential, and as a result, there is a concern that an error such as density unevenness or stripes may occur in an output image.

Here, with respect to determination of the state of the charging member, various techniques have been proposed.

SUMMARY

According to an aspect of the invention, there is provided a charging member contamination determining device including:

plural units that includes a charging member, a member to be charged and a measuring section that measures a discharging current value between the charging member and the member to be charged;

a calculating section that calculates a difference between current values measured by two units among the plural units; and a determining section that determines the presence or absence of contamination in the charging member based on the difference between the current values for each combination of two units calculated by the calculating section.

BRIEF DESCRIPTION OF THE DRAWINGS

Exemplary embodiments of the present invention will be described in detail based on the following figures, wherein.

DETAILED DESCRIPTION

An exemplary embodiment of the invention will be described with reference to the accompanying drawings.

First, an image forming apparatus provided with a charging member contamination determining device according to the exemplary embodiment will be described. The image forming apparatus is an apparatus having a function of forming an image on a recording material such as a sheet, which is provided as a copier, a printer, a facsimile or a multifunction device having these functions.

Figure 1:
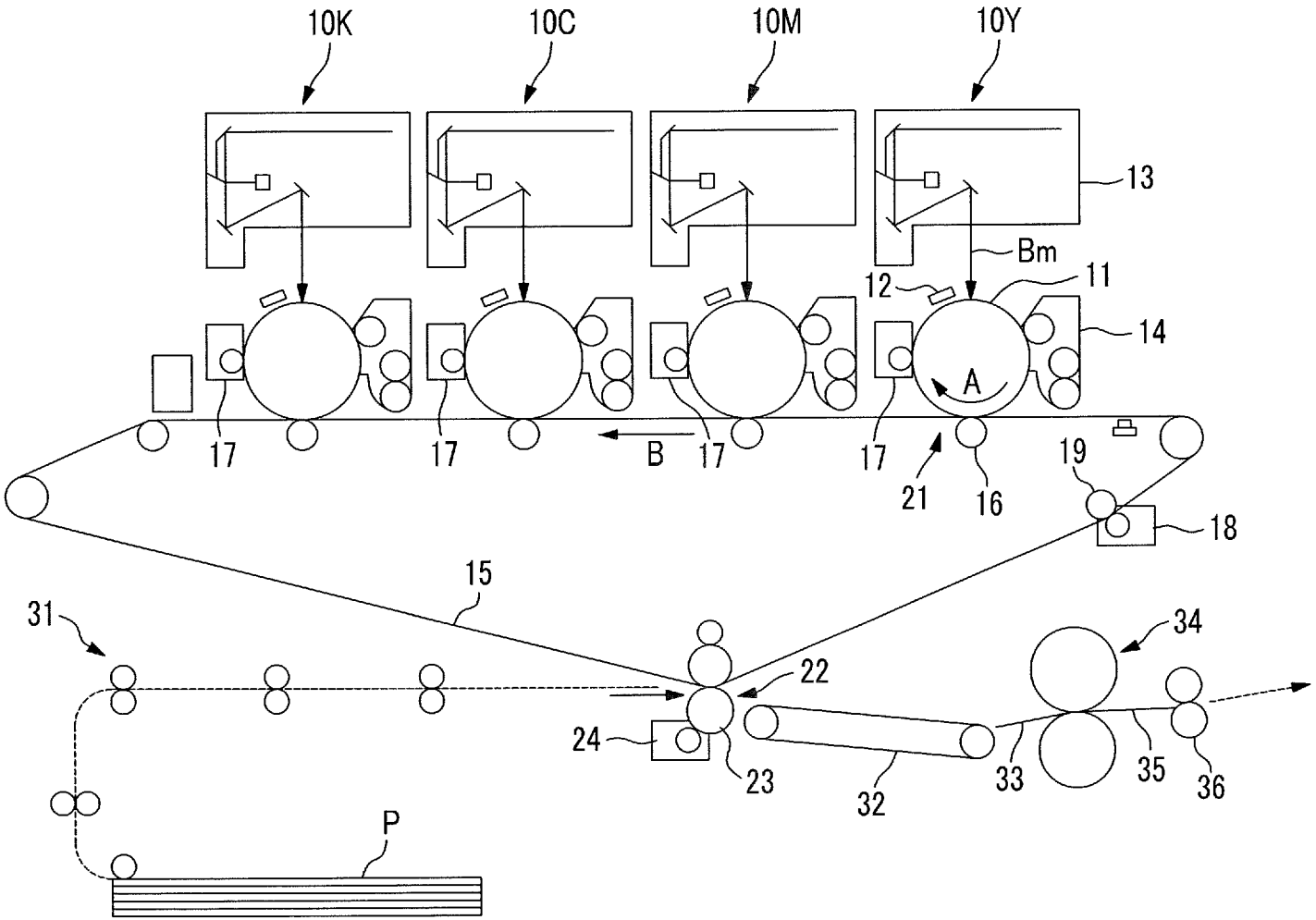
FIG. 1 is a diagram illustrating an example of an internal structure of an image forming apparatus according to an exemplary embodiment of the invention.

FIG. 1 is a diagram illustrating an example of an internal structure of an image forming apparatus according to an exemplary embodiment of the invention.

The image forming apparatus illustrated in FIG. 1 is an intermediate image transfer type that is generally called a tandem type, and includes plural image forming units 10Y, 10M, 10C and 10K that form toner images of respective color components by an electrophotographic technique, a primary image transfer unit 21 that sequentially transfers (primarily transfers) the toner images of the respective color components formed by the respective image forming units 10Y, 10M, 10C and 10K onto an intermediate image transfer belt 15, a secondary image transfer unit 22 that collectively transfers (secondarily transfers) the overlapped toner images transferred to the intermediate image transfer belt 15 onto a sheet P (an example of the recording material), and a fixing unit 34 that fixes the secondarily transferred image to the sheet P, as representative functional sections.

Each of the image forming units 10Y, 10M, 10C and 10K includes a photoconductor drum 11 that rotates in a direction of arrow A in the figure. Further, various electrophotographic devices including a charger 12 that charges the photoconductor drum 11, an exposing unit 13 that irradiates the photoconductor drum 11 with an exposure beam Bm to write an electrostatic latent image, a developing unit that accommodates toner of each color component and visualizes the electrostatic latent image on the photoconductor drum 11 by the toner to form a toner image, and a primary image transfer roller 16 that transfers, in an overlapping manner, the toner image of each color component formed on the photoconductor drum 11 onto the intermediate image transfer belt 15 using the primary image transfer unit 21 are sequentially arranged around each of the photoconductor drums 11.

These image forming units 10Y, 10M, 10C and 10K are arranged in an approximately linear form in the order of yellow (Y), magenta (M), cyan (C) and black (K) from an upstream side of the intermediate image transfer belt 15, and are configured to be contactable with and detachable from the intermediate image transfer belt 15.

Further, the image forming apparatus illustrated in FIG. 1 includes, as a sheet transport system, a sheet supply mechanism unit 31 that performs a sheet supply operation of extracting a sheet P from a sheet accommodator and sending the sheet P to the secondary image transfer unit 22, a transport belt 32 that transports the sheet P passed through the second image transfer unit 22 toward the fixing unit 34, a fixing input port guide 33 that guides the sheet P to an input port of the fixing unit 34, a sheet discharge guide 35 that guides the sheet P discharged from the fixing unit 34 toward a downstream side, and sheet discharge rollers 36 that discharge the sheet P guided by the sheet discharge guide 35 to the outside of the apparatus.

That is, the sheet P supplied to the secondary image transfer unit 22 from the sheet accommodator by the sheet supply mechanism unit 31 is subject to electrostatic transfer of the toner image on the intermediate image transfer belt 15 in the secondary image transfer unit 22, and is then transported to the transport belt 32 in a state of being separated from the intermediate image transfer belt 15. Further, the sheet P is transported to the fixing unit 34 through the fixing input port guide 33 in accordance with an operation speed of the fixing unit 34 by the transport belt 32. The non-fixed toner image on the sheet P transported to the fixing unit 34 is fixed to the sheet P by being subject to a fixing process of applying heat and pressure in the fixing unit 34. Then, the sheet P formed with the fixed image is transported to a discharged sheet accommodator (not illustrated) provided at an outer part of the apparatus through the sheet discharge guide 35 and the sheet discharge rollers 36.

Figure 2:
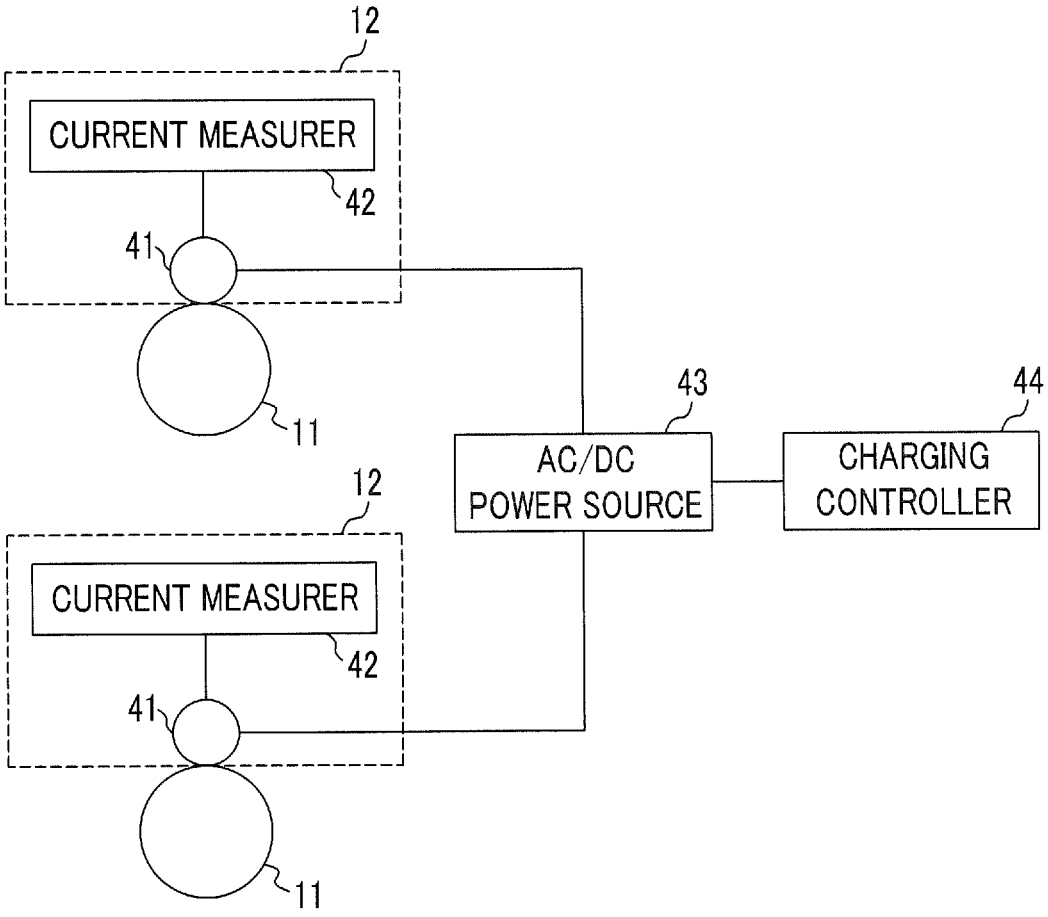
FIG. 2 is a diagram illustrating an example of functional blocks of a charging unit provided in the image forming apparatus illustrated in FIG. 1.

FIG. 2 is a diagram illustrating an example of functional blocks of the charging unit that charges the photoconductor drum 11.

In this example, the charging unit includes the charger 12 that is provided for each photoconductor drum 11, an AC/DC power source 43 that supplies a charging bias to the respective chargers 12, and a charging controller 44 that controls the supply of the charging bias from the AC/DC power source 43. That is, in this example, the supply source of the charging bias is provided in common, and the charging bias of the same amplitude, phase and frequency is supplied to the respective chargers 12. Here, the supply source of the charging bias may be different for each charger 12 as long as the charging bias of the same amplitude, phase and frequency may be supplied to the respective chargers 12.

Each charger 12 includes a charging roller 41 that is provided in contact with or close to the photoconductor drum 11. The charging bias supplied from the AC/DC power source 43 is applied to the charging roller 41 so that discharging is generated between the charging roller 41 and the photoconductor drum 11 to charge the photoconductor drum 11 to a target electric potential.

Further, each charger 12 also includes a current measurer 42 that measures a discharging current value due to the charging roller 41 (a current value flowing in the photoconductor drum 11 due to discharging).

Here, if the charging roller 41 is contaminated due to attachment of toner, carrier or the like, or if the charging roller 41 is contaminated from the inside due to abrasion, it is difficult to uniformly charge the photoconductor drum 11 due to the contamination. As a result, unevenness of the toner density on the photoconductor drum 11 occurs, and thus, there is a concern that an error such as density unevenness or stripes may occur in an output image. Thus, in order to prevent or treat the error, it is necessary to immediately detect, if any, the contamination of the charging roller 41, and to promptly perform maintenance such as cleaning or exchange of the corresponding component.

Since the photoconductor drums 11 and the chargers 12 of the respective color components (Y, M, C and K) are normally operated in the same conditions (the same conditions such as a use environment and a use time), deterioration (for example, abrasion) of the photoconductor drums 11 advances basically in the same manner (but the deterioration state of K may be different from those of the other colors due to a frequency difference of black-and-white printing or the like), and also, a factor (a resistance value of the photoconductor drum 11 or the like) that affects the current value measured by the current measurer 42 changes in the same manner.

Accordingly, when the charging bias of the same amplitude, phase and frequency is applied to the respective charging rollers 41, and when all charging rollers 41 are not contaminated, the current values measured by the current measurers 42 are extremely close to each other. On the other hand, when any charging roller 41 is contaminated, it is understood that the current value relating to this charging roller 41 is different from the current values relating to the other charging rollers 41.

In this example, using this phenomenon, the current values relating to the respective charging rollers 41 are compared with each other, and it is checked whether there is a charging roller 41 having a significant difference in its current value compared with those of the other charging rollers 41. Then, if there is such a charging roller 41, it is determined that contamination is present in the charging roller 41.

Figure 3:
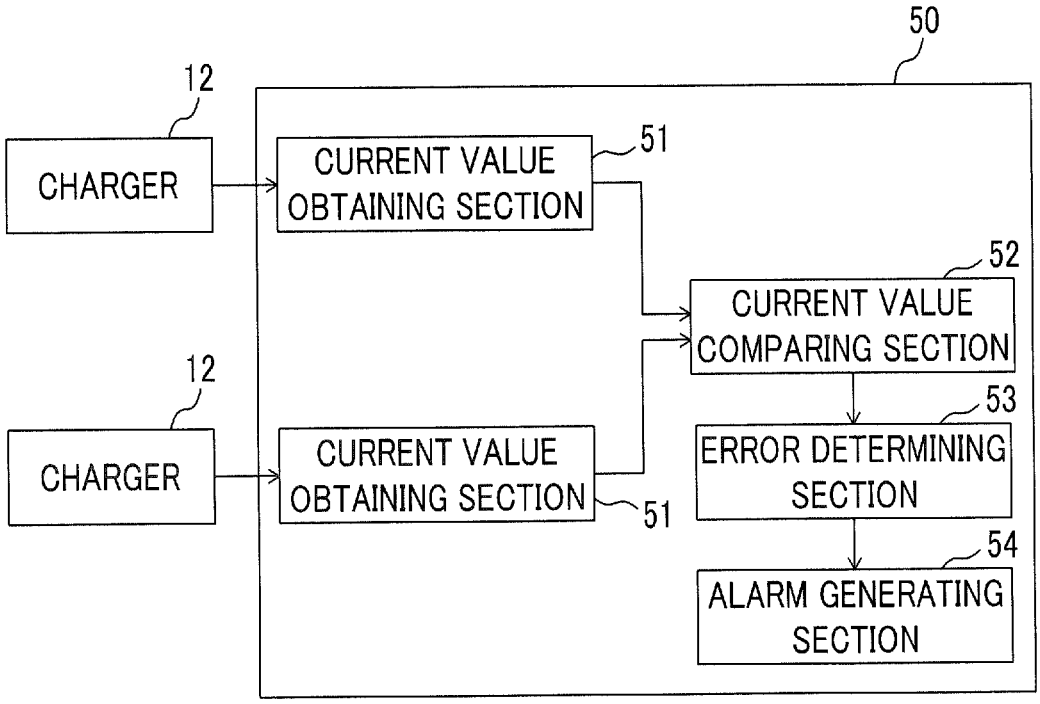
FIG. 3 is a diagram illustrating an example of functional blocks of a charging member contamination determining device provided in the image forming apparatus illustrated in FIG. 1.

FIG. 3 is a diagram illustrating an example of functional blocks of a charging member contamination determining device that determines the presence or absence of contamination in a charging member (in this example, the charging rollers 41) provided in a charging unit.

A charging member contamination determining device 50 in this example is built into the image forming apparatus, and includes a current value obtaining section 51, a current value comparing section 52, an error determining section 53, and an alarm generating section 54.

The current value obtaining section 51 is provided for each charger 12, and obtains the current value measured by the current measurer 42 (the discharging current value due to the charging roller 41).

The current value comparing section 52 calculates a difference between the current values (a current value difference) for each combination of two charging rollers 41 based on the current value of each charging roller 41 obtained by each current value obtaining section 51 during execution of an image forming process.

The error determining section 53 determines the presence or absence of contamination in the charging rollers 41 based on the current value difference for each combination of two charging rollers 41 calculated by the current value comparing section 52.

Here, since the charging unit in this example has the structure in which the charging bias of the same amplitude, phase and frequency is supplied to the chargers 12 of the respective color components, in the case of the combination of the charging rollers 41 that are not contaminated, the current values measured in the respective charging rollers 41 at the same timing are extremely close to each other, and thus, the current value difference relating to this combination is small. On the other hand, in the case of the combination including a charging roller 41 that is contaminated, the current values measured in the respective charging rollers 41 at the same timing are different from each other, and thus, the current value difference relating to this combination tends to be large. Further, it is checked whether there is a combination having the current value difference that is larger than a predetermined threshold value. Then, if there is the combination having the current value difference that is larger than the threshold value, it is determined that the contamination is present in at least one of two charging rollers 41 relating to this combination. Further, when contamination is present in one charging roller 41 and is not present in another charging roller 41, since the current value difference is larger than the threshold value in all the combinations including the contaminated charging roller 41, it is determined that contamination is present in the charging roller 41 that is common to these combinations (the combinations in which the current value difference is larger than the threshold value).

The alarm generating section 54 performs, when it is determined by the error determining section 53 that contamination is present in the charging roller 41, an alarm output for notifying a user or the like of the contamination.

In this example, the alarm generating section 54 outputs information indicating that contamination is present in the charging roller 41 (and information for identifying the contaminated charging roller 41) to a display unit (for example, an operation panel) of the image forming apparatus to notify the user of the image forming apparatus of the information, but instead, the output may be performed in a different form such as a printing output, a sound output or the like. Further, for example, the information may be transmitted to a computer in a management center connected for communication to the image forming apparatus, and may be output to a display device for the computer to be notified to a serviceman, a manager or the like.

Next, a contamination determining technique in the charging member contamination determining device 50 in this example will be described in comparison with a different technique.

First, a comparative example will be described with reference to FIGS. 4A and 4B.

Figure 4A:
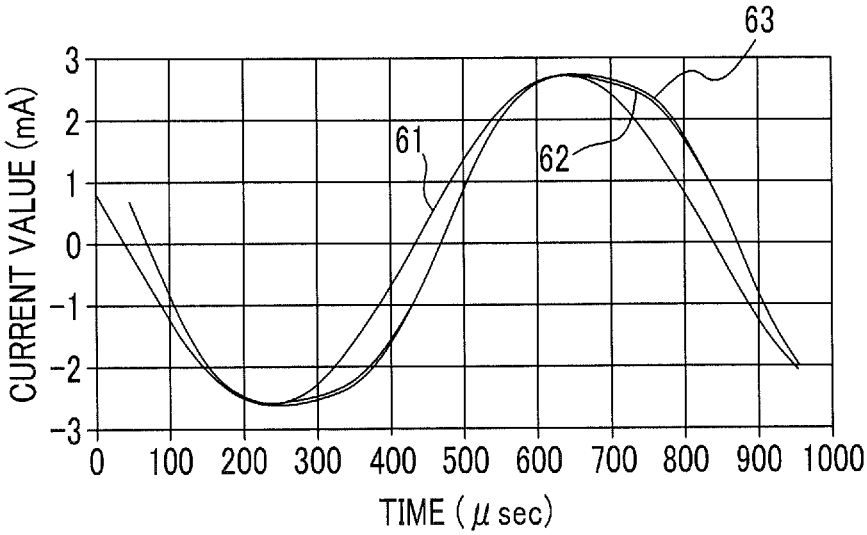
FIGS. 4A and 4B are diagrams illustrating examples of waveforms of a current value and a current value difference according to a technique of a comparative example.

FIG. 4A illustrates a waveform 61 of a current value obtained in the charging roller 41 in a non-contaminated state, a waveform 62 of a current value obtained in the charging roller 41 in a contaminated state, and a waveform 63 of a current value obtained in the charging roller 41 in which the discharging does not occur. In a graph of FIG. 4A, the transverse axis represents elapsed time (μsec), and the longitudinal axis represents a current value (mA).

As illustrated in FIG. 4A, when the waveforms of the current values in the non-contaminated state and the contaminated state are compared with each other, their difference is small. Thus, it may be understood that it is difficult to determine the presence or absence of contamination with the simple comparison of the measured current values.

Figure 4B:
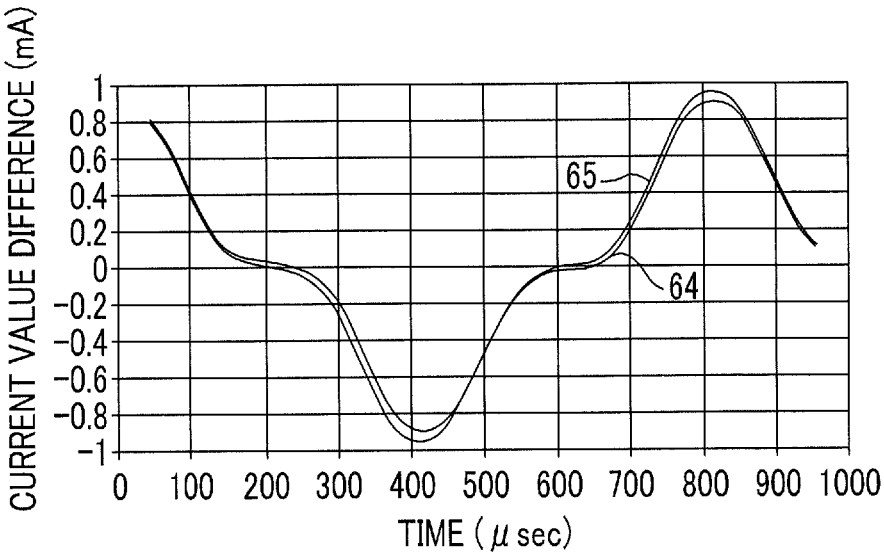

FIG. 4B illustrates a waveform 64 of a current value difference obtained by subtracting the current value in the non-discharging state from the current value in the non-contaminated state, and a waveform 65 of a current value difference obtained by subtracting the current value in the non-discharging state from the current value in the contaminated state. In a graph of FIG. 4B, the transverse axis represents elapsed time (μsec), and the longitudinal axis represents a current value difference (mA).

As illustrated in FIG. 4B, when the waveforms of the current value differences obtained by the subtraction of the current value in the non-discharging state are compared with each other, their difference is small, similarly to the case in FIG. 4A. Thus, it may be understood that it is difficult to determine the presence or absence of contamination with the comparison of the differences with the current values in the non-discharging state.

Next, the contamination determination in the charging member contamination determining device 50 will be described with reference to FIG. 5.

Figure 5:
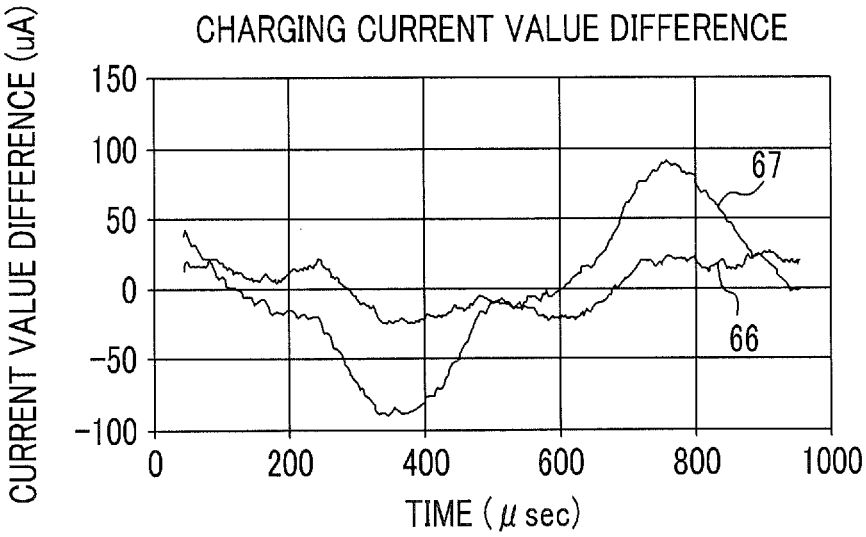
FIG. 5 is a diagram illustrating an example of a waveform of a current value difference according to an exemplary embodiment of the invention.

In FIG. 5, it is assumed that the plural charging rollers 41 are operated in the same conditions (the same conditions such as a use environment and a use time), and a current value obtained in one charging roller 41 in a non-contaminated state among the plural charging rollers 41 is used as a reference. Here, FIG. 5 illustrates a waveform 66 of a current value difference obtained by subtracting the reference current value from a current value obtained in the charging roller 41 in the non-contaminated state, and a waveform 67 of a current value difference obtained by subtracting the reference current value from a current value obtained in another charging roller 41 in the contaminated state. In a graph of FIG. 5, the transverse axis represents elapsed time (μsec), and the longitudinal axis represents a current value difference (μA).

As illustrated in FIG. 5, when the waveforms of the current value differences obtained by the subtraction of the reference current value are compared with each other, the waveform 66 of the current value difference relating to the non-contaminated state is within a range of −50 μA to +50 μA, whereas the waveform 67 of the current value difference relating to the contaminated state has a region that is beyond the above range. Thus, for example, by using 50 μA as a threshold value and by continuously determining whether an absolute value of the current value difference obtained by the subtraction of the reference current value is larger than the threshold value (50 μA), it is possible to easily determine the presence or absence of the contamination.

When the current value obtained in the charging roller 41 in the contaminated state is used as a reference, in any other charging roller 41 (the charging roller 41 in the non-contaminated state), the current value difference obtained by subtracting the reference current value from the current value obtained in the charging roller 41 in the non-contaminated state has a region that is beyond the above range. Thus, in this case, it is possible to determine that the contamination is present in the charging roller 41 relating to the reference.

Here, in the present technique, it is not necessary to perform a process such as addition of the amount of charges, and thus, it is not necessary to prepare a memory that accumulates the measured current values in a time-series manner. Thus, it is possible to determine the presence or absence of contamination in the charging rollers 41 in real time during execution of the image forming process.

When making the charging biases of the respective charging rollers 41 be different from each other, a memory that accumulates the measured current values in a time-series manner may be prepared, and the application of the charging bias may be performed for about one cycle. Then, the current values accumulated in the memory in a time-series manner may be corrected. Further, a current value difference may be calculated for the corrected current values and may be compared with a threshold value to determine the presence or absence of contamination in the charging roller 41. For example, when AC voltages of different phases are applied to the plural charging rollers 41, the measured current values for about one AC cycle (for 1,000 μsec if the frequency is about 1 kHz as in FIGS. 4A and 4B) are accumulated, and values derived from a reference value (a maximum value, a minimum value, an average value or the like) measured from the plural charging rollers 41 from the accumulated current values are matched to adjust the phase. Then, a current value difference is calculated and compared with a threshold value to determine the presence or absence of the contamination.

Next, a specification of a contaminated charging roller 41 will be described with reference to FIGS. 6 to 8.

Figure 6:
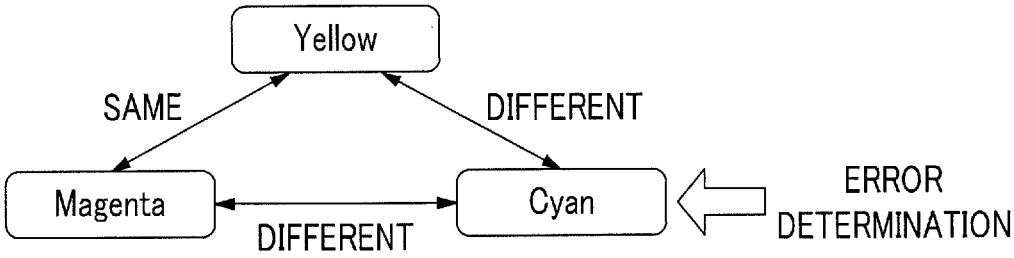
FIG. 6 is a diagram illustrating a case where contamination is present in one of three charging units.

FIG. 6 is a diagram illustrating an example of a case where three (Y, M and C) charging rollers 41 are provided and the contamination is present in one of the charging rollers. In FIG. 6, a combination of Y and M shows a current value difference smaller than a threshold value (the same current value), and thus, it is possible to determine that the contamination is not present in the Y and M chargers 12 relating to this combination. On the other hand, a combination of Y and C and a combination of M and C show current value differences larger than the threshold value (different current values), and thus, it is possible to determine that the contamination is present in the C charging roller 41 common to the these combinations.

Figure 7:
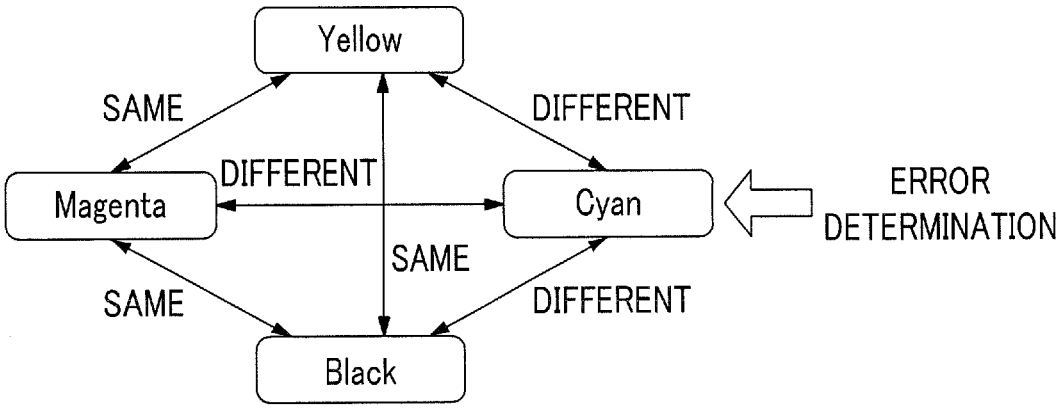
FIG. 7 is a diagram illustrating a case where contamination is present in one of four charging units.

FIG. 7 is a diagram illustrating an example of a case where four (Y, M, C and K) charging rollers 41 are provided and the contamination is present in one of the charging rollers. In FIG. 7, a combination of Y and M, a combination of Y and K and a combination of M and K show current value differences smaller than a threshold value (the same current value), and thus, it is possible to determine that the contamination is not present in the Y, M and K charging rollers 41 relating to these combinations. On the other hand, a combination of Y and C, a combination of M and C and a combination of C and K show current value differences larger than the threshold value (different current values), and thus, it is possible to determine that the contamination is present in the C charging roller 41 common to the these combinations.

Figure 8:
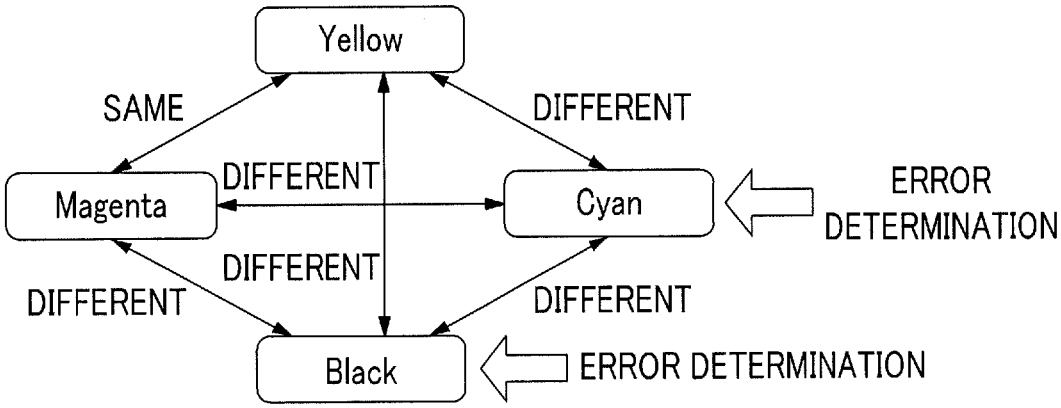
FIG. 8 is a diagram illustrating a case where contamination is present in two of four charging units.

FIG. 8 is a diagram illustrating an example of a case where four (Y, M, C and K) charging rollers 41 are provided and the contamination is present in two of the charging rollers. In FIG. 8, a combination of Y and M shows a current value difference smaller than a threshold value (the same current value), and thus, it is possible to determine that the contamination is not present in the Y and M charging rollers 41 relating to these combinations. On the other hand, a combination of Y and C, a combination of M and C and a combination of C and K show current value differences larger than the threshold value (different current values), and thus, it is possible to determine that the contamination is present in the C charging roller 41 common to the these combinations. Further, a combination of Y and K, a combination of M and K and a combination of C and K show current value differences larger than the threshold value (different current values), and thus, it is possible to determine that the contamination is present in the K charging roller 41 common to the these combinations.

Next, an extended example of the charging member contamination determining device 50 will be described with reference to an example of functional blocks illustrated in FIG. 9.

Figure 9:
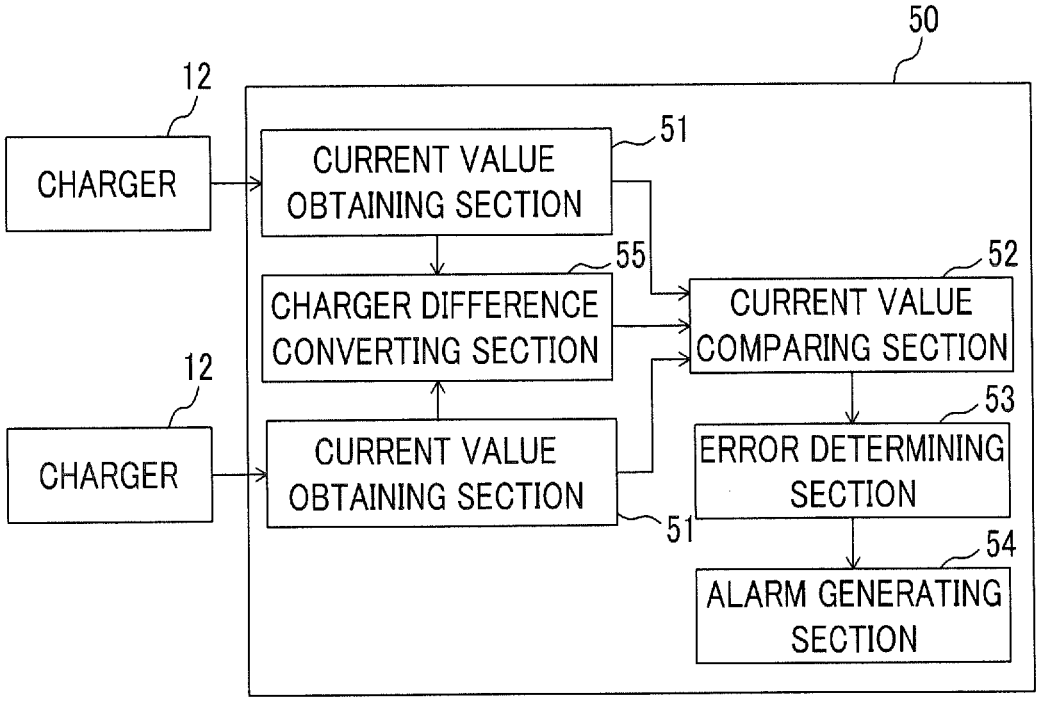
FIG. 9 is a diagram illustrating another example of functional blocks of a charging member contamination determining device.

The charging member contamination determining device 50 illustrated in FIG. 9 has a configuration in which a charger difference converting section 55 is additionally provided in the charging member contamination determining device 50 illustrated in FIG. 3. With respect to the same configuration as in the charging member contamination determining device 50 illustrated in FIG. 3, description thereof will not be repeated.

The charger difference converting section 55 obtains a current value for each charging roller 41 using each current value obtaining section 51 in a state where the contamination is not present in all the charging rollers 41, creates conversion data for correcting the current value so that a current value difference is not present, and stores and retains the conversion data in a memory.

When the current value for each charging roller 41 is obtained during the image forming process, the current value comparing section 52 corrects the current value for each charging roller 41 based on the conversion data created in advance, and calculates a difference of the current values (current value difference) for each combination of two charging rollers 41 based on the corrected current values.

In this way, in the charging member contamination determining device 50 illustrated in FIG. 9, when the current values measured in the respective charging rollers 41 in the non-contaminated state are different from each other, the current value differences are checked in advance to create the conversion data, are reflected in the current values obtained in the determination of the presence or absence of the contamination, and comparison is performed. Thus, even when the respective charging rollers 41 are operated in different conditions due to exchange of a part of the photoconductor drums 11 or the like, it is possible to determine the presence or absence of contamination in the charging rollers 41.

Here, the creation of the conversion data may be performed at any time as long as it is performed in a state where the contamination is not present in the charging rollers 41, and for example, may be performed at installation of the image forming apparatus, at exchange of the photoconductor drum 11, or the like. Further, the creation may be performed immediately after electric power is supplied to the image forming apparatus. In this case, it is possible to determine the presence or absence of contamination in the charging rollers 41 immediately after the electric power is supplied to the image forming apparatus. Further, the creation may be performed immediately before a job relating to the image forming process is started. In this case, it is possible to determine the presence or absence of contamination in the charging rollers 41 due to the job.

Figure 10:
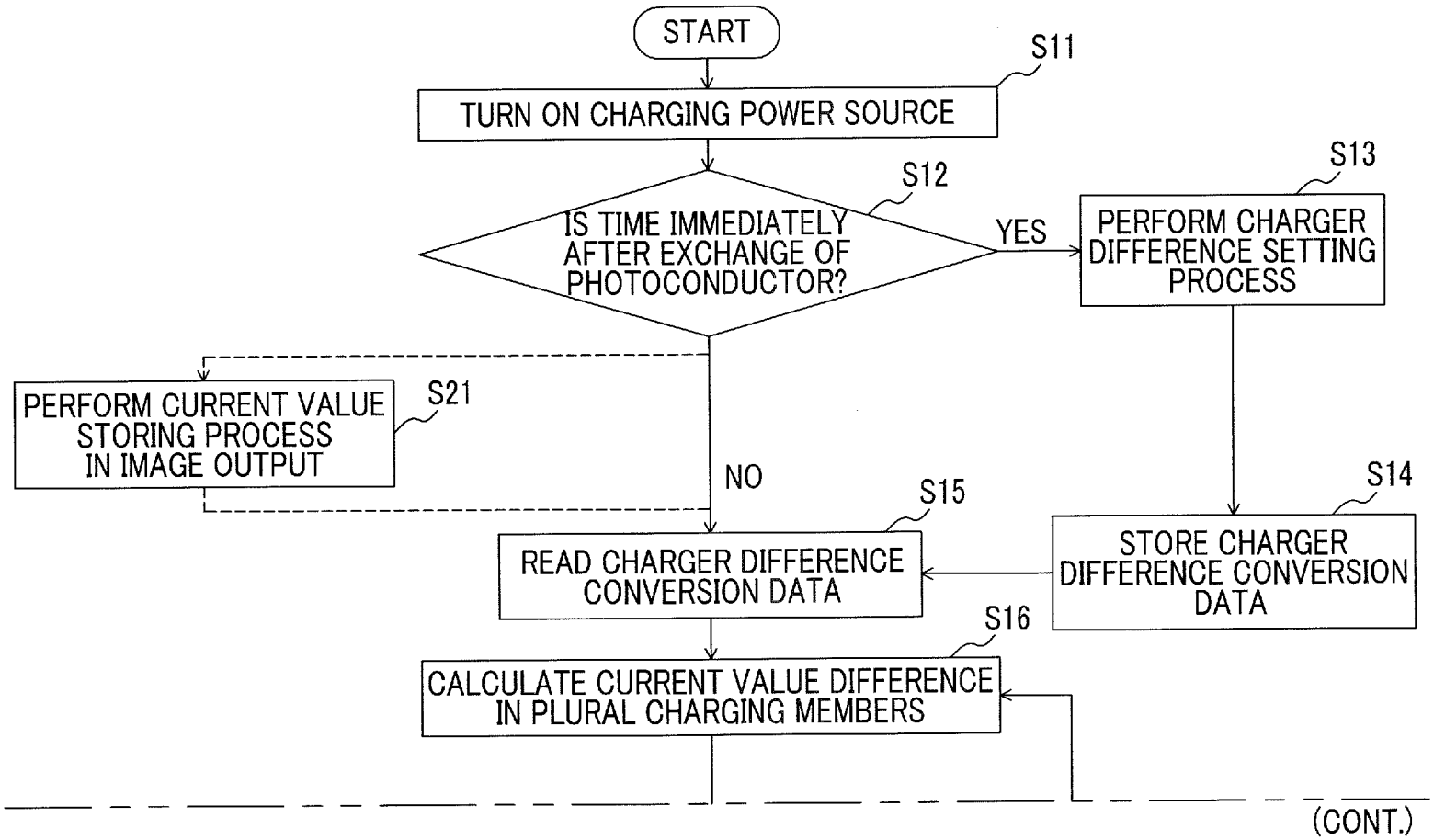
FIG. 10 is a diagram illustrating an example of a process flow in the charging member contamination determining device illustrated in FIG. 9.

FIG. 10 is a diagram illustrating a process flow in the charging member contamination determining device 50 illustrated in FIG. 9.

If the job relating to the image forming process is received and the charging power source (the AC/DC power source 43) is turned on (step S11), the charging member contamination determining device 50 determines whether a condition where the conversion data is created is satisfied (in this example, whether it is a time immediately after any photoconductor drum 11 is exchanged) (step S12).

If it is determined in step S12 that the condition where the conversion data is created is satisfied, the charging member contamination determining device 50 obtains the current value for each charging roller 41 before the job relating to the image forming process is started, creates the conversion data based on the obtained current value for each charging roller 41, and stores (retains) the created conversion data in the memory (steps S13 and S14).

Thereafter (after step S12 or S14), the charging member contamination determining device 50 reads the conversion data from the memory (step S15), and then, obtains the current value for each charging roller 41 during execution of the job relating to the image forming process, corrects the obtained current value for each charging roller 41 based on the conversion data created in advance, and calculates a difference in the current values (current value difference) for each combination of two charging rollers 41 (step S16).

Then, the charging member contamination determining device 50 determines whether the contamination is present in the charging rollers 41 based on the current value difference for each combination of two charging rollers 41 (step S17).

If it is determined in step S17 that the contamination is not present in the charging rollers 41, the charging member contamination determining device 50 performs the job relating to the image forming process to perform a print output (step S18). Then, the charging member contamination determining device 50 determines whether the job is finished (step S19). If it is determined that the job is not finished, the procedure returns to step S16. Then, steps S16 to S18 are repeated until it is determined that the job relating to the image forming process is finished.

On the other hand, if it is determined in step S17 that the contamination is present in the charging rollers 41, the charging member contamination determining device 50 performs an alarm output for notifying a user or the like of the contamination, and stops the job relating to the image forming process to stop the print output (step S20).

In the above-described process flow, the current value for each charging roller 41 is not accumulated in the memory, and it is determined in real time whether contamination is present in the charging rollers 41 during execution of the job relating to the image forming process. Here, a process of accumulating the current value for each charging roller 41 in the memory may be performed (step S21). Then, after the current values are accumulated in a time-series manner for a certain period of time (for example, 1,000 μsec), the conversion data may be read (step S15), or the current value differences may be calculated (step S16).

Further, in the above description, the photoconductor drum 11 of a drum shape is used as the member to be charged, but a member to be charged of a different shape, such as a photoconductor belt of a belt shape, may be used.

Further, in the above description, the charging roller 41 of a roller shape is used as the charging member, but a charging member of a different shape, such as a charging belt of a belt shape, may be used.

Here, in the image forming apparatus in this example, there is provided a computer including hardware resources such as a central processing unit (CPU) that performs various arithmetic processes, a main memory such as a random access memory (RAM) that is a work area of the CPU and a read only memory (ROM) on which a basic control program is recorded, an auxiliary memory such as a hard disk drive (HDD) that stores various programs and data, a display device that performs a display output of various information, an input/output interface that is an interface for an input unit such as buttons or a touch panel used for an input operation of an operator, and a communication interface that is an interface for performing communication with other apparatuses in a wired or wireless manner.

Further, a program according to an exemplary embodiment of the invention is read from the auxiliary memory or the like and is loaded into the RAM, and then, is executed by the CPU. Thus, the functions of the charging member contamination determining device according to the exemplary embodiment are realized on the computer of the image forming apparatus.

In this example, an obtaining function according to the exemplary embodiment is realized by the current value obtaining section 51, a calculating function (a function of a calculating section) according to the exemplary embodiment is realized by the current value comparing section 52, and a determining function (a function of a determining section) according to the exemplary embodiment is realized by the error determining section 53.

Here, the program according to the exemplary embodiment may be installed in the computer of the image forming apparatus in the form of being read from an external storage medium such as a CD-ROM that stores the program or in the form of being received through a communication network, for example.

Here, the invention is not limited to the configuration in which the respective functional sections are realized by a software configuration as in this example, and each functional section may be realized by an exclusive hardware module.

Further, in the above description, the image forming apparatus (the charging member contamination determining device built into the image forming apparatus) determines the presence or absence of contamination in the charging member, but a different apparatus connected for communication with the image forming apparatus may determine the presence or absence of contamination in the charging member. That is, for example, a system including a management server connected for communication with plural image forming apparatuses may be provided, in which the management server may obtain a current value for each charging member from each image forming apparatus to calculate a current value difference and may determine the presence or absence of contamination in the charging member based on the calculation result.

The invention may be applied to various systems or apparatuses, programs thereof, methods thereof, or the like that determine the presence or absence of contamination in a charging member of an image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member contamination determining device comprising:

a plurality of units that includes a charging member, a member to be charged and a measuring section that measures a discharging current value between the charging member and the member to be charged;

a calculating section that calculates a difference between discharging current values measured by two units among the plurality of units; and a determining section that determines the presence or absence of contamination in the charging member based on the difference between the discharging current values for each combination of two units calculated by the calculating section.

2. The charging member contamination determining device according to claim 1, wherein the determining section determines, when there is a combination in which the difference between the discharging current values is larger than a predetermined threshold value, that the contamination is present in at least one of two charging members relating to the combination.

3. The charging member contamination determining device according to claim 1, wherein the determining section determines, when there is a plurality of combinations in which the difference between the discharging current values is larger than a predetermined threshold value, that the contamination is present in a charging member common to the plurality of combinations.

4. The charging member contamination determining device according to claim 2, wherein the determining section determines, when there is a plurality of combinations in which the difference between the discharging current values is larger than a predetermined threshold value, that the contamination is present in a charging member common to the plurality of combinations.

5. The charging member contamination determining device according to claim 1, wherein the determining section corrects the current value for each charging member measured by the measuring section during execution of an image forming process based on the current value for each charging member measured by the measuring section in a non-contaminated state, and the difference between the discharging current values is calculated based on a corrected current value for each charging member.

6. The charging member contamination determining device according to claim 2, wherein the determining section corrects the current value for each charging member measured by the measuring section during execution of an image forming process based on the current value for each charging member measured by the measuring section in a non-contaminated state, and the difference between the discharging current values is calculated based on a corrected current value for each charging member.

7. The charging member contamination determining device according to claim 3, wherein the determining section corrects the current value for each charging member measured by the measuring section during execution of an image forming process based on the current value for each charging member measured by the measuring section in a non-contaminated state, and the difference between the discharging current values is calculated based on a corrected current value for each charging member.

8. The charging member contamination determining device according to claim 4, wherein the determining section corrects the current value for each charging member measured by the measuring section during execution of an image forming process based on the current value for each charging member measured by the measuring section in a non-contaminated state, and the difference between the discharging current values is calculated based on a corrected current value for each charging member.

9. The charging member contamination determining device according to claim 2, wherein the predetermined threshold value is 50 ρA.

10. The charging member contamination determining device according to claim 1, wherein the determining unit continuously determines whether an absolute value of the difference between the discharging current values is larger than a predetermined value.

11. The charging member contamination determining device according to claim 1, further comprising:

a memory that accumulates measured discharging current values in a time-series manner, wherein when the charging biases of the respective charging member are different from each other, an application of the charging bias is performed for about one cycle of the discharging current that is alternating current and the measured current values accumulated in the memory are corrected, and the determining section determines the presence or absence of contamination based on the corrected current values.

* * * * *